US011395053B2

(12) United States Patent
Tsuchihashi et al.

(10) Patent No.: US 11,395,053 B2
(45) Date of Patent: Jul. 19, 2022

(54) SPEAKER HOUSING

(71) Applicant: YAMAHA CORPORATION, Hamamatsu (JP)

(72) Inventors: Yu Tsuchihashi, Hamamatsu (JP); Akira Miki, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 17/200,036

(22) Filed: Mar. 12, 2021

(65) Prior Publication Data

US 2021/0329357 A1 Oct. 21, 2021

Related U.S. Application Data

(63) Continuation of application No. PCT/JP2019/036150, filed on Sep. 13, 2019.

(30) Foreign Application Priority Data

Sep. 14, 2018 (JP) ..... JP2018-172549

(51) Int. Cl.
*H04R 1/02* (2006.01)

(52) U.S. Cl.
CPC ..... *H04R 1/026* (2013.01); *H04R 1/023* (2013.01)

(58) Field of Classification Search
CPC ..... H04R 1/026; H04R 1/023
See application file for complete search history.

(56) References Cited

U.S. PATENT DOCUMENTS 3,953,675 A * 4/1976 Babb ..... H04R 1/2888 181/198
4,168,762 A * 9/1979 Griffin, Jr. ..... H04R 1/2834 181/163
2006/0225950 A1* 10/2006 Ishida ..... H04R 1/021 181/199
2015/0027805 A1* 1/2015 Tsai ..... H04R 1/02 264/319

FOREIGN PATENT DOCUMENTS

JP S5846613 U 3/1983
JP S60230797 A 11/1985
JP S6144986 U 3/1986
(Continued)

OTHER PUBLICATIONS

Office Action issued in Japanese Appln. No. 2020-546229 dated Sep. 7, 2021. English machine translation provided.
(Continued)

*Primary Examiner* — Andrew L Sniezek
(74) *Attorney, Agent, or Firm* — Rossi, Kimms & McDowell LLP

(57) ABSTRACT

A speaker housing includes: a front wall to which a speaker unit is to be attached; at least one first wall; at least one second wall; and a plurality of ribs attached to the first wall, wherein an internal space is formed by the front wall, the first wall, and the second wall, a plurality of meshes that segment the first wall are defined, and shapes of the ribs are determined based on directions of a maximum principal stress generated in the meshes due to vibrations when the vibrations occur in a state where the ribs are not provided in the first wall.

11 Claims, 8 Drawing Sheets

(56) References Cited

FOREIGN PATENT DOCUMENTS

| | | | |
|---|---|---|---|
| JP | S6430354 | U | 2/1989 |
| JP | H11289589 | A | 10/1999 |
| JP | 2007123963 | A | 5/2007 |

OTHER PUBLICATIONS

English translation of Written Opinion issued in Intl. Appln. No. PCT/JP2019/036150 dated Nov. 5, 2019, previously cited in IDS filed Mar. 12, 2021.
International Preliminary Report on Patentability issued in Intl. Appln. No. PCT/JP2019/036150 dated Mar. 25, 2021. English translation provided.
International Search Report issued in Intl. Appln. No PCT/JP2019/036150 dated Nov. 5, 2019. English translation provided.
Written Opinion issued in Intl. Appln. No. PCT/JP2019/036150 dated Nov. 5, 2019.

* cited by examiner

SPEAKER HOUSING

TECHNICAL FIELD

This invention relates to a speaker housing.

BACKGROUND ART

In a speaker, vibrations occur in a speaker housing due to sound emission. These vibrations in the speaker housing significantly affect the quality of sound reproduced by the speaker. In this regard, a technique of controlling the quality of reproduced sound by increasing the rigidity of the speaker housing has been provided.

In a technique disclosed in JP S58-046613Y2, a plurality of ribs are provided on surfaces of inner walls of a speaker housing. Here, the ribs have a straight shape extending in a distal direction of the housing, and have different sizes. According to this technique, the sound quality of the speaker can be changed and improved by changing a vibration mode of the speaker housing.

In a technique disclosed in JP H01-030354A, recessed and protruding portions are provided on inner walls of a speaker housing. Here, the recessed and protruding shape in a plan view is a shape such as an ellipse, a rectangle, a straight shape, a curved shape, or a wave-like shape. By providing repetition of such recesses and protrusions, it is possible to increase the rigidity of the speaker housing and shorten a substantial vibration span on a plate material that constitutes the speaker housing to suppress a resonance phenomenon, without increasing the overall thickness of the plate material.

SUMMARY

If ribs or recesses and protrusions are provided on the inner walls of the speaker housing as disclosed in the above prior arts, the rigidity of the speaker housing increases, and vibrations in the speaker housing can be suppressed. However, the techniques disclosed in the above prior arts are not designed for increasing rigidity focusing on vibrations in a specific mode that affects the quality of reproduced sound, of the vibrations occurring in the speaker housing. For this reason, to suppress degradation of the quality of reproduced sound, large-scale ribs or recesses and protrusions with which a large rigidity can be obtained need to be provided for a wide range of vibration modes that may occur in the speaker housing, which leads to an increase in the weight of the speaker housing.

This invention has been made in view of the foregoing situation, and aims to provide a technical means for increasing rigidity with respect to vibrations in a specific mode while avoiding an increase in the weight of a speaker housing, and suppressing degradation of the quality of reproduced sound.

A first speaker housing according to the present invention includes: a front wall to which a speaker unit is to be attached; at least one first wall; at least one second wall; and a plurality of ribs provided on the first wall, wherein an internal space is formed by the front wall, the first wall, and the second wall, a plurality of meshes that segment the first wall are defined, and shapes of the ribs are determined based on directions of a maximum principal stress generated in the meshes due to vibrations when the vibrations occur in a state where the ribs are not provided in the first wall.

A second speaker housing according to the present invention includes: a front wall to which a speaker unit is to be attached; at least one first wall; at least one second wall; and a plurality of ribs provided on the first wall, wherein an internal space is formed by the front wall, the first wall, and the second wall, the plurality of ribs are arranged substantially in parallel in a first direction, and at least some of the plurality of ribs curve so as to protrude toward one of two sides in the first direction.

A third speaker housing according to the present invention comprising: a front wall where a speaker is to be attached; at least one first wall; at least one second wall; and a plurality of ribs disposed on the first wall, wherein the front wall, the first wall, and the second wall form an internal space, a plurality of meshes that segment the first wall are defined, and the ribs are shaped according to contours of the direction of a maximum principal stress induced in the meshes by vibrations applied to the first wall in a state where the ribs are not disposed on the first wall.

A forth speaker housing according to the present invention comprising: a front wall where a speaker is to be attached; at least one first wall; at least one second wall; and a plurality of ribs disposed on the first wall, wherein the front wall, the first wall, and the second wall form an internal space, wherein the plurality of ribs are disposed spaced along a first direction, and wherein at least some of the plurality of ribs are curved protruding along the first direction toward one of two opposing sides of the first direction.

DESCRIPTION OF EMBODIMENTS

Hereinafter, embodiments of this invention will be described with reference to the drawings.

Figure 1:
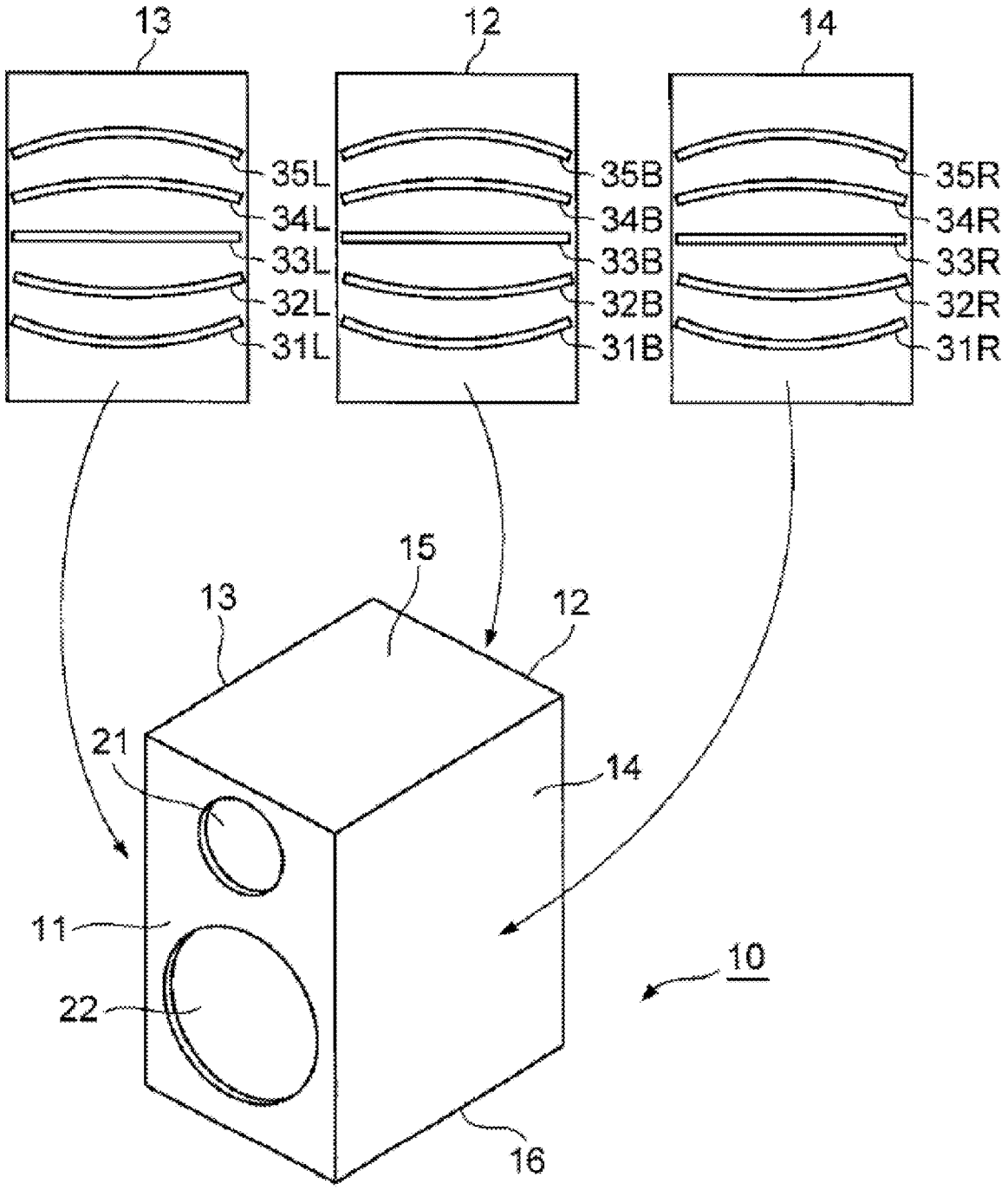
FIG. 1 is a diagram showing a configuration of a speaker housing that is an embodiment of this invention.

FIG. 1 is a diagram showing a configuration of a speaker housing 10 that is an embodiment of this invention. This speaker housing 10 has a front wall 11, a back wall 12 that opposes the front wall 11, a left wall 13 and a right wall 14 that sandwich an internal space between the front wall 11 and the back wall 12 from left and right, and a top wall 15 and a bottom wall 16 that sandwich the internal space from above and below. Holes 21 and 22 for accommodating a speaker unit are formed in the front wall 11.

A plurality of ribs 31L to 35L with different shapes are arranged and fixed substantially in parallel on an inner wall face of the left wall 13. Here, the ribs 31L to 35L are arranged in a direction from a lower short side of the left wall 13 toward an upper short side.

The rib 33L is located substantially in the middle among the ribs 31L to 35L, and has a straight shape parallel to the top wall 15 and the bottom wall 16 on the upper and lower sides of the left wall 13 in a plan view. The ribs 34L and 35L, which are arranged above the rib 33L, have a curved shape that bulges upward in a plan view, or more specifically, an arc shape. The ribs 32L and 31L, which are arranged below the rib 33L, have a curved shape that bulges downward in a plan, or more specifically, an arc shape. That is to say, the ribs 31L to 35L include the ribs 34L and 35L and the ribs 32L and 31L that bulge in a direction in which the ribs are arranged with the rib 33L in the middle. The curvature radius of the rib 35L is smaller than the curvature radius of the rib 34L, and the curvature radius of the rib 31L is smaller than the curvature radius of the rib 32L. The closer the ribs are to the ribs (specifically, the ribs 35L and 31L) at two ends in the arrangement direction relative to the rib (specifically, the rib 33L) near the middle in the arrangement direction, the smaller the curvature radius of the ribs 31L to 35L is.

Ribs 31R to 35R, which have shapes similar to those of the ribs 31L to 35L, are also arranged and fixed in the vertical direction on an inner wall face of the right wall 14. Ribs 31B to 35B, which have shapes similar to those the ribs 31L to 35L, are also arranged and fixed in the vertical direction on an inner wall face of the back wall 12.

Figure 2A:
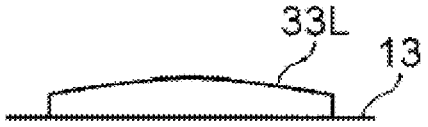
FIG. 2A is a diagram showing an example configuration of a rib on a left wall of the speaker housing in FIG. 1.
Figure 2B:
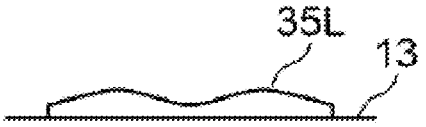
FIG. 2B is a diagram showing an example configuration of a rib on a back wall of the speaker housing in FIG. 1.

In the present embodiment, the height of the ribs from the inner wall faces of the housing varies depending on their position in the longitudinal direction. FIG. 2A is a diagram showing the rib 33L fixed to the left wall 13 viewed from a direction parallel to the left wall 13. FIG. 2B is a diagram showing the rib 35L fixed to the left wall 13 viewed from the direction parallel to the left wall 13.

As shown in FIG. 2A, the height of the rib 33L from the left wall 13 increases from the two ends of the rib in the longitudinal direction toward the middle in the longitudinal direction. As shown in FIG. 2B, the height of the rib 35L from the left wall 13 increases as it extends away from two ends of the rib in the longitudinal direction, and then decreases toward the middle in the longitudinal direction. Although omitted in the diagrams, the same applies to the other ribs 31L, 32L, and 34L, and the height of the ribs from the inner wall face of the housing inner varies depending on the position in the longitudinal direction. The same applies to the ribs 31R to 35R on the right wall 14 and the ribs 31B to 35B on the back wall 12.

In the present embodiment, the average height of the ribs 31L to 35L from the left wall 13 decreases from the middle in the arrangement direction toward the two sides in the arrangement direction. The same applies to the ribs 31R to 35R on the right wall 14 and the ribs 31B to 35B on the back wall 12. Here, the average height means the average height of the ribs at each position in the longitudinal direction.

Figure 3A:
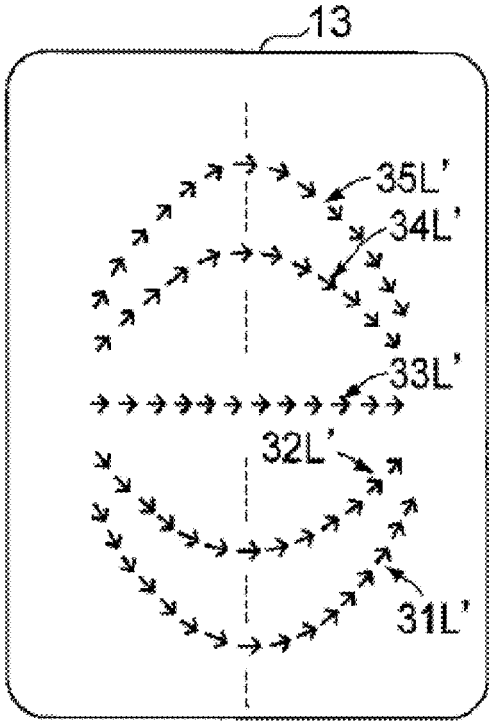
FIG. 3A is a diagram showing a distribution of stress generated in the left wall when vibrations in a primary mode are generated.
Figure 3B:
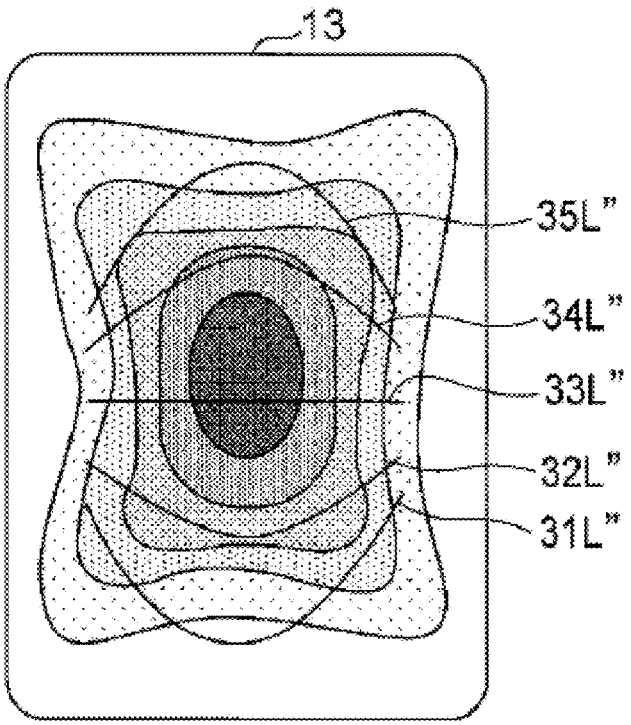
FIG. 3B is a diagram showing a distribution of von Mises stress in the left wall in a state where the stress in FIG. 3A is generated.
Figure 4A:
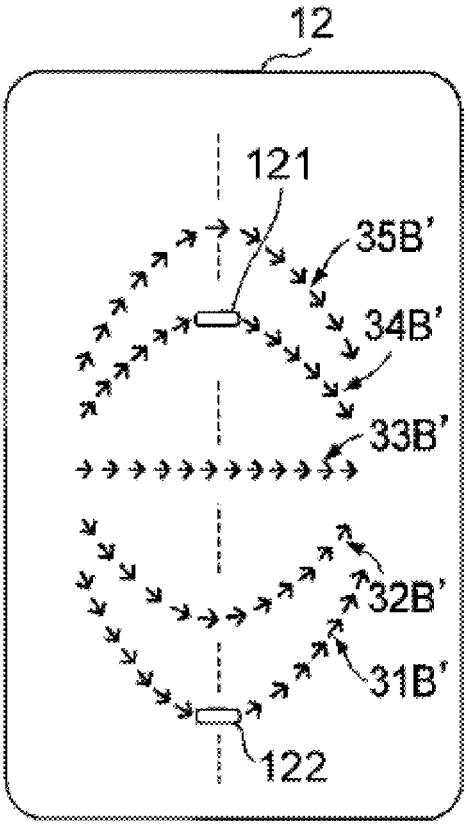
FIG. 4A is a diagram showing a distribution of stress generated in the back wall when vibrations in the primary mode are generated.
Figure 4B:
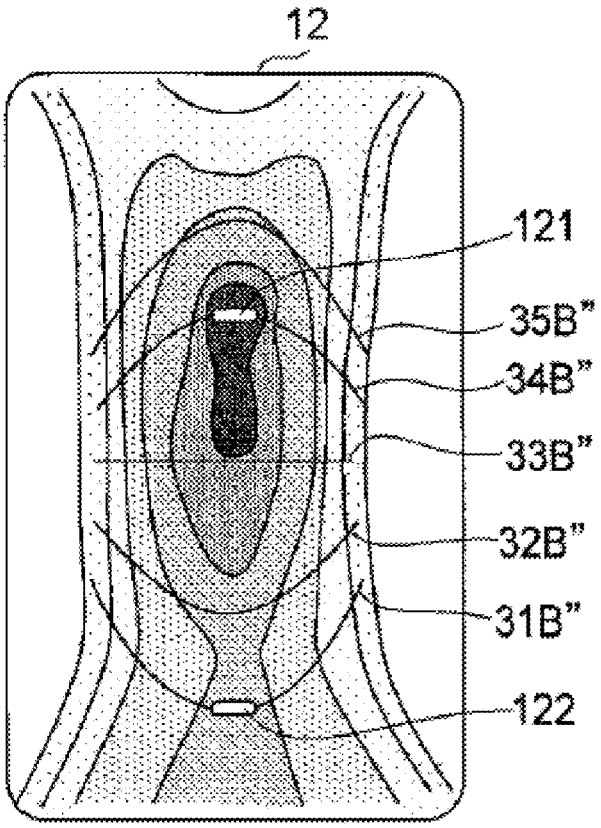
FIG. 4B is a diagram showing a distribution of von Mises stress in the back face in a state where the stress in FIG. 4A is generated.

FIGS. 3 and 4 are diagrams illustrating a method for determining the shapes of the ribs according to the present embodiment. Regarding measures against vibrations in the speaker housing, the measures against vibrations in a primary mode, in which the contribution of emitted sound is large, is considered to be important. For this reason, the inventor of the present application caused the primary vibration mode to be generated in the speaker housing 10 in which the ribs are not provided, and obtained a distribution of stress that is generated in each of the walls of the speaker housing 10 in this state. FIGS. 3A and 4A show distributions of stress generated in the left wall 13 and the back wall 12, respectively, when vibrations in the primary mode were generated. FIGS. 3B and 4B show distributions of von Mises stress at each position in the inner wall faces in the housing in a state where the stress shown in FIGS. 3A and 4A is generated. Here, the von Mises stress refers to a scalar value of the stress. In FIGS. 3B and 4B, the von Mises stress is expressed by the density of dots, and the higher the von Mises stress in a region is, the higher the density of dots in this region is. Note that, in FIGS. 4A and 4B, 121 and 122 denote holes that are formed in the back wall 12 in order to take out wires, for example.

FIGS. 3A and 4A show curved lines and straight lines (hereinafter simply referred to as lines) 31L' to 35L' and lines 31B' to 35B', which are arranged substantially in parallel from the lower short sides of the left wall 13 and the back wall 12 toward the upper short sides, and are obtained by connecting a plurality of arrows. An arrow at each position on these lines schematically indicates the maximum principal stress at this position. These lines 31L' to 35L' and lines 31B' to 35B' have shapes that are based on the maximum principal stress direction at each position on the wall faces of the left wall 13 or the back wall 12. Specifically, the shapes of the lines 31L' to 35L' and the line 31B' to 35B' are determined such that the maximum principal stress direction at each position on the respective lines continues on the left wall 13 and the back wall 12. Although various methods can be considered as the method for determining the lines 31L' to 35L' and the lines 31B' to 35B', the lines may be determined as follows, for example.

Figure 5:
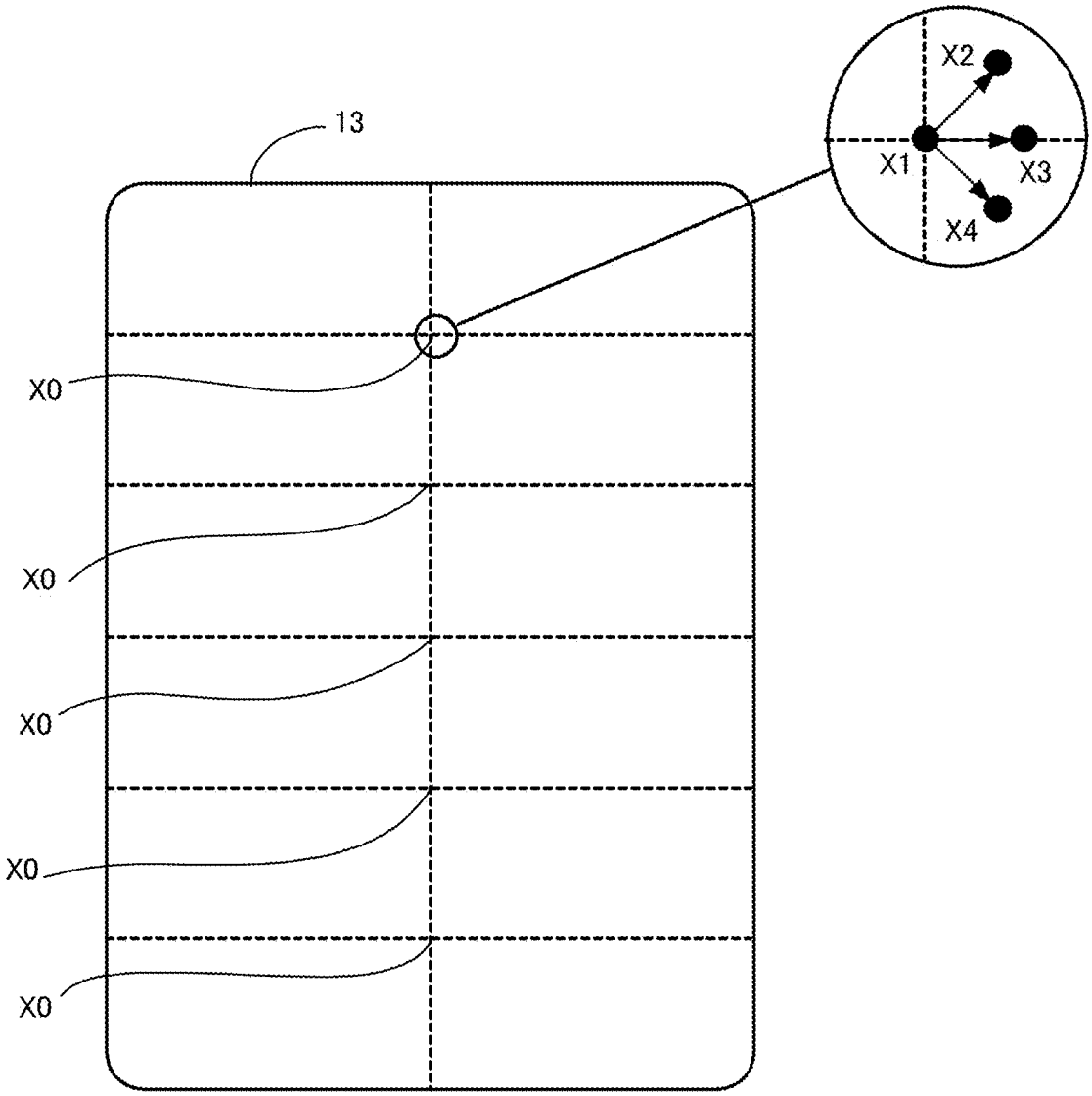
FIG. 5 is a diagram illustrating a method for determining the shape of a rib.

First, the wall faces of the left wall 13 and the back wall 12 are segmented to form fine meshes (e.g. meshes with a maximum outer diameter of 1 to 5 mm), and the maximum principal stress in each of the meshes is obtained. Next, as shown in FIG. 5, a section from the upper side to the lower side of each of the left wall 13 and the back wall 12 is substantially evenly divided into six subsections, and the five dividing positions in the middle in the left-right direction are set as initial positions X0. Next, portions rightward from the initial positions X0 on the lines 31L' to 35L' and the lines 31B' to 35B' are obtained. Specifically, as shown in an enlarged view in FIG. 5, each of the initial positions X0 is assumed to be a current position X1, the maximum principal stress in the mesh at the current position X1 is compared with the maximum principal stress in the meshes at an upper right position X2, a right position X3, and a lower right position X4 with respect to the mesh at the current position X1, and a mesh is selected in which the maximum principal stress with the closest orientation and magnitude is generated. The thus-selected mesh is set as a mesh at the current position, and the same processing is repeated. Thus, the shapes of the portions of the lines 31L' to 35L' and the lines 31B' to 35B' on the right side of the initial positions X0 are determined. The shapes of the portions of the lines 31L' to 35L' and the lines 31B' to 35B' on the left side of the initial positions X0 are determined through the same processing.

Here, since stress and distortion are in a proportional relationship, the maximum principal stress direction can be considered as a direction in which a large distortion is occurring. Accordingly, it is conceivable that if the rigidity in the maximum principal stress direction in which a large distortion occurs is increased, the rigidity can be effectively increased with respect to vibrations in the primary mode. For this reason, in the present embodiment, lines are obtained that form a curved or straight shape along which the maximum principal stress at each position on the lines extending along the respective walls continues, and ribs extending along these lines are fixed to the inner wall faces of the speaker housing 10.

That is to say, as shown in FIG. 1, five ribs are formed on each of the left wall 13, the back wall 12, and the right wall 14. The shapes of the ribs 31L to 35L, 31R to 35R, and 31B to 35B in FIG. 1 are determined so as to thus extend along continuous curved or straight lines drawn by the maximum principal stress in the meshes on the lines on the wall faces of the speaker housing 10 in which the ribs are not provided.

Specifically, for example, in the left wall 13 in FIG. 1, the rib (first rib) 33L disposed near the middle in the vertical direction is disposed extending straight in the horizontal direction, and the ribs (second ribs) 34L and 35L, which are disposed above the rib 33L, curve so as to protrude upward. Meanwhile, the ribs (third ribs) 32L and 31L, which are disposed below 33L, curve so as to protrude downward. The ribs 31B to 35B and 31R to 35R in the other walls 12 and 14 are also formed in the same manner.

As mentioned above, in the present embodiment, the height of each rib from the inner wall face of the housing is varied in the vertical direction. The reason will be described below.

As shown in FIGS. 3B and 4B, the von Mises stress is not uniform over the inner wall faces of the housing, and generally, the von Mises stress is at its maximum in the middle of the inner wall faces of the housing, and the von Mises stress decreases toward the periphery of the inner wall faces of the housing. Accordingly, the von Mises stress is not uniform either on the lines 31L' to 35L' and 31B' to 35B' along which the maximum principal stress continues, and the von Mises stress varies in the longitudinal direction of the lines.

FIG. 3A shows lines 31L" to 35L" that correspond respectively to the lines 31L' to 35L' shown in FIG. 3B, and FIG. 4B shows lines 31B" to 35B" that correspond respectively to the lines 31B' to 35B' shown in FIG. 4A. According to FIG. 3B, for example, the von Mises stress in the meshes on the line 33L" increases from a left end of the line 33L" toward the middle, and decreases from the middle toward a right end. The von Mises stress on the line 35L" increases once rightward from a left end of the line 35L", then decreases therefrom toward the middle, increases once again rightward from the middle, and then decreases therefrom toward a right end.

Here, in order to sufficiently increase the rigidity with respect to vibrations in a specific mode, it is thought that it is effective to provide rigidity corresponding to the von Mises stress that is locally generated in each mesh, at a position on a rib corresponding to the mesh. In the present embodiment, the height of the ribs 31L to 35L, 31R to 35R, and 31B to 35B at a position corresponding to each mesh is a height corresponding to the von Mises stress at this position in the corresponding inner wall face of the housing, and thus, the local rigidity of the ribs corresponds to the local von Mises stress. Note that the height of each rib is not specifically limited, but may be 5 to 20 mm, for example, and is preferably 10 to 15 mm. The width of each rib may also be the same as the height.

Figure 6:
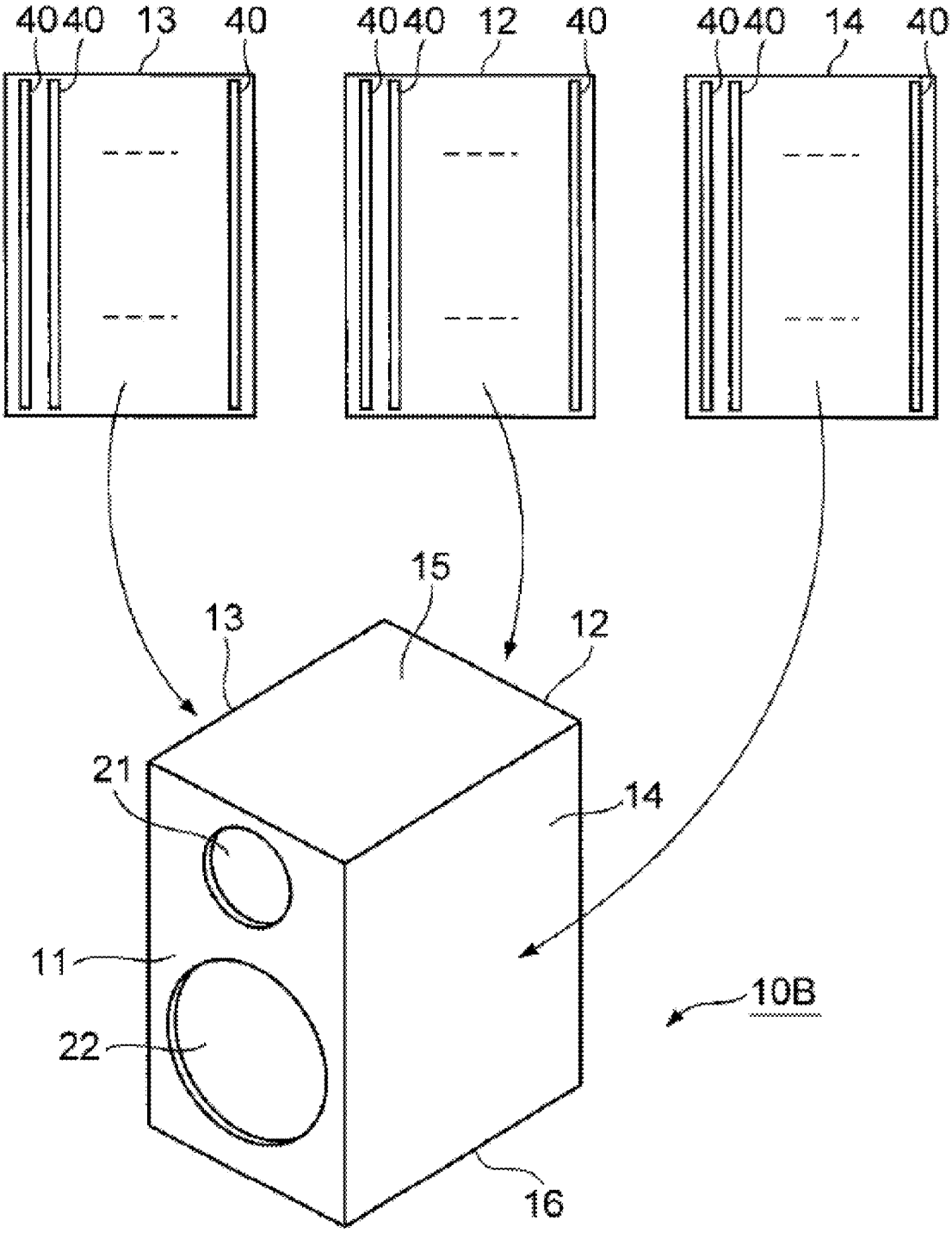
FIG. 6 is a diagram showing a configuration of a speaker housing that is a third comparative example of the same embodiment.

Next, the effects of the present embodiment will be described in comparison with the following first to third comparative examples. This first comparative example is a common speaker housing with no rib provided, and the plate thickness of the left wall and the right wall is 5 mm. This plate thickness is also the same in the present embodiment and the third comparative example. The second comparative example is a speaker housing in which the plate thickness of the left wall and the right wall is 2 mm greater than in the first comparative example. The third comparative example is a speaker housing 10B in which a plurality of ribs 40, which extend in parallel in the vertical direction, are fixed to inner wall faces of a left wall 13, a right wall 14, and a back wall 12, as shown in FIG. 6. The height of the ribs 40 from the inner fall faces is 5 mm, and the width is 5 mm. The speaker housing 10 according to the present embodiment is basically a housing with the configuration in FIG. 1. However, the height of the ribs 31L to 35L, 31R to 35R, and 31B to 35B was not varied in accordance with the position in the longitudinal direction, and was set uniformly to 5 mm. The width was also set to 5 mm.

Figure 7:
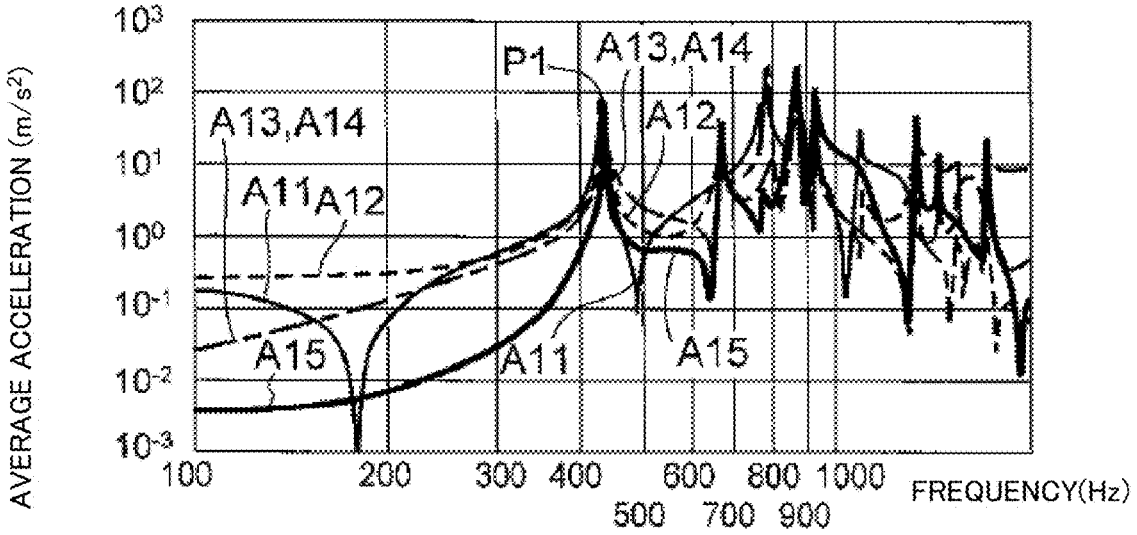
FIG. 7 is a diagram showing frequency characteristics of vibrations occurring in a speaker housing that is a first comparative example of the same embodiment.
Figure 8:
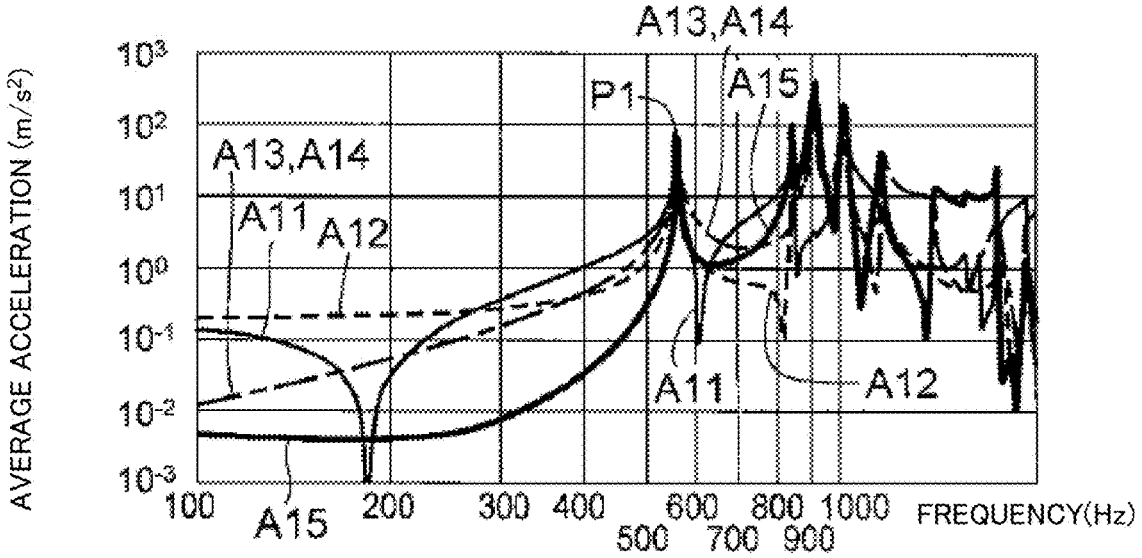
FIG. 8 is a diagram showing frequency characteristics of vibrations occurring in a speaker housing that is a second comparative example of the same embodiment.
Figure 9:
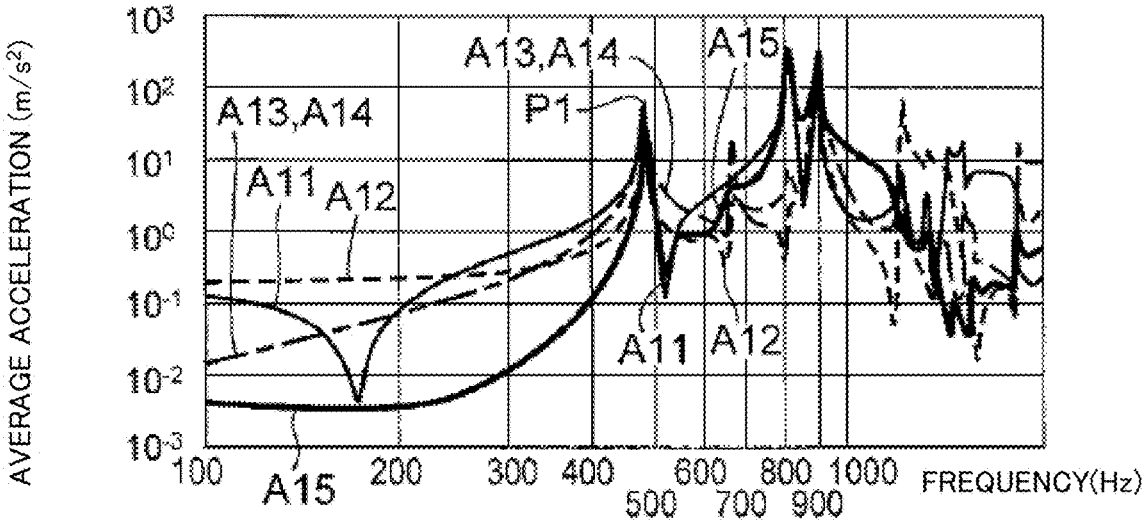
FIG. 9 is a diagram showing frequency characteristics of vibrations occurring in a speaker housing that is the third comparative example of the same embodiment.
Figure 10:
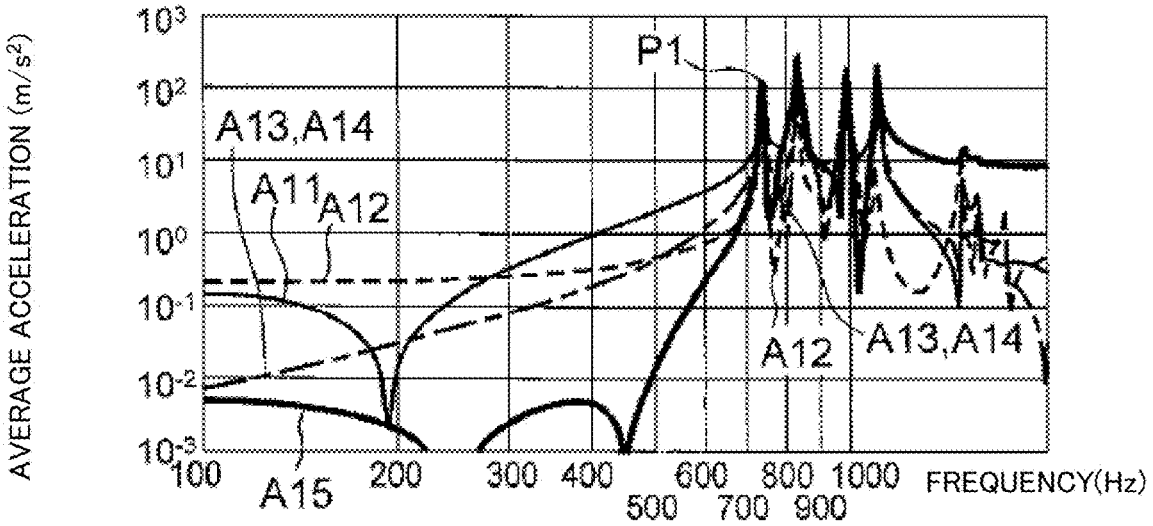
FIG. 10 is a diagram showing frequency characteristics of vibrations occurring in the speaker housing according to the same embodiment.

FIGS. 7 to 9 are diagrams showing frequency characteristics of vibrations occurring in the wall faces of the speaker housings due to sound emission in the first to third comparative examples. FIG. 10 is a diagram showing frequency characteristics of vibrations occurring in the wall faces of the speaker housing due to sound emission in the speaker housing 10 according to the present embodiment. In FIGS. 7 to 10, the horizontal axis indicates the frequency (Hz), and the vertical axis indicates the average acceleration (m/s2) of vibrations in the walls. A11 denotes a frequency characteristic of vibrations occurring in the front wall 11, A12 denotes a frequency characteristic of vibrations occurring in the back wall 12, A13 denotes a frequency characteristic of vibrations occurring in the left wall 13, A14 denotes a frequency characteristic of vibrations occurring in the right wall 14, and A15 denotes a frequency characteristic of vibrations occurring in the top wall 15.

According to FIGS. 7 to 10, the frequency with which a peak P1 in the primary vibration mode is generated is 425 Hz in the first comparative example (FIG. 7), 535 Hz in the second comparative example (FIG. 8), 485 Hz in the third comparative example (FIGS. 6 and 9), and 730 Hz in the present embodiment (FIGS. 1 to 10). Thus, according to the present embodiment, the frequency in the primary vibration mode can be greatly increased compared with the first to third comparative examples. In addition, according to the present embodiment, it is possible to greatly increase the frequency in the primary vibration mode and suppress degradation of the quality of sound reproduced by the speaker without greatly increasing the weight of the speaker housing, compared with the second and third comparative examples.

An embodiment of the present invention has been described above, but there may also be other embodiments of this invention. For example, the following embodiments are possible. Note that one or more of the following examples can be combined.

Figure 11A:
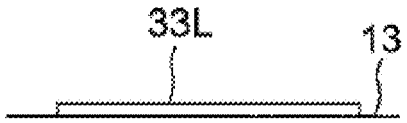
FIG. 11A is a diagram showing an example configuration of a rib fixed to an inner wall face of a speaker housing that is another embodiment of this invention.
Figure 11B:
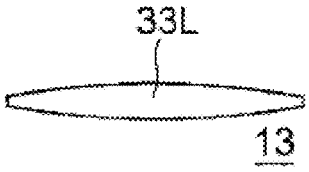
FIG. 11B is a diagram showing an example configuration of a rib fixed to an inner wall face of a speaker housing that is another embodiment of this invention.

(1) In the above embodiment, the height of each rib is varied in the longitudinal direction of the rib in order to obtain rigidity corresponding to the local von Mises stress at positions corresponding to the meshes of the rib. However, instead of employing this configuration, the width of each rib may be varied in the longitudinal direction thereof, as shown as an example in FIG. 11. Alternatively, both the height and the width of each rib may be varied in the longitudinal direction thereof. That is to say, the size of at least one of the height and the width of each rib may be varied in the longitudinal direction of the rib.

(2) In the above embodiment, the ribs are fixed to the left wall 13, the right wall 14, and the back wall 12 of the speaker housing 10, but the ribs may also be fixed to the other walls, or may be fixed to all of the walls. That is to say, the ribs can also be provided on one or more of the left wall 13, the right wall 14, the back wall 12, the top wall 15, and the bottom wall 16. Since the ribs can be provided on all of the walls, the ribs can also be provided on a second wall according to the present invention.

(3) In the above embodiment, five ribs are fixed to one inner wall face, but the number of ribs is not limited thereto. More than five ribs, or less than five ribs may be fixed. Different numbers of ribs may be fixed on different inner wall faces. In the above embodiment, the rib near the middle in the vertical direction is formed straight, the ribs thereabove curve so as to protrude upward, and the ribs therebelow curve so as to protrude downward. However, the present invention is not limited thereto. For example, two or more straight ribs may be provided, or no straight rib may be provided. The straight rib may alternatively be disposed at a position other than a position near the middle in the vertical direction. All of the ribs can also be formed to curve so as to protrude downward, or curve so as to protrude upward. That is to say, at least some of the plurality of ribs arranged in parallel may curve. The curvature radius of the ribs is not specifically limited either.

(4) In the above embodiment, the ribs are fixed onto the inner faces of the speaker housing, but the installation mode of the ribs is not limited to fixation. For example, the ribs may alternatively be formed in the inner wall faces by means of drilling or the like.

(5) In the above embodiment, the ribs are formed so as to extend substantially in the horizontal direction. However, as long as the ribs are provided along the main stress direction in the meshes, the ribs can alternatively be provided substantially in the vertical direction, or the directions in which the plurality of ribs extend may include a plurality of mixed directions such as substantially the horizontal direction and substantially the vertical direction.

In the above embodiment, when the direction in which the ribs extend is determined, meshes are selected such that the direction and the magnitude of the main stress in adjacent meshes are close to each other, but the present invention is not limited thereto. That is to say, the direction and the magnitude of the main stress need not be close to each other in all of the adjacent meshes. The direction and the magnitude may slightly differ from each other in some of the adjacent meshes. The direction in which the ribs extend may also be determined in accordance with the thus-selected meshes. Also, the ribs need not be continuous, and the ribs may alternatively be disposed with predetermined gaps therebetween in the direction in which the ribs extend.

Figure 12:
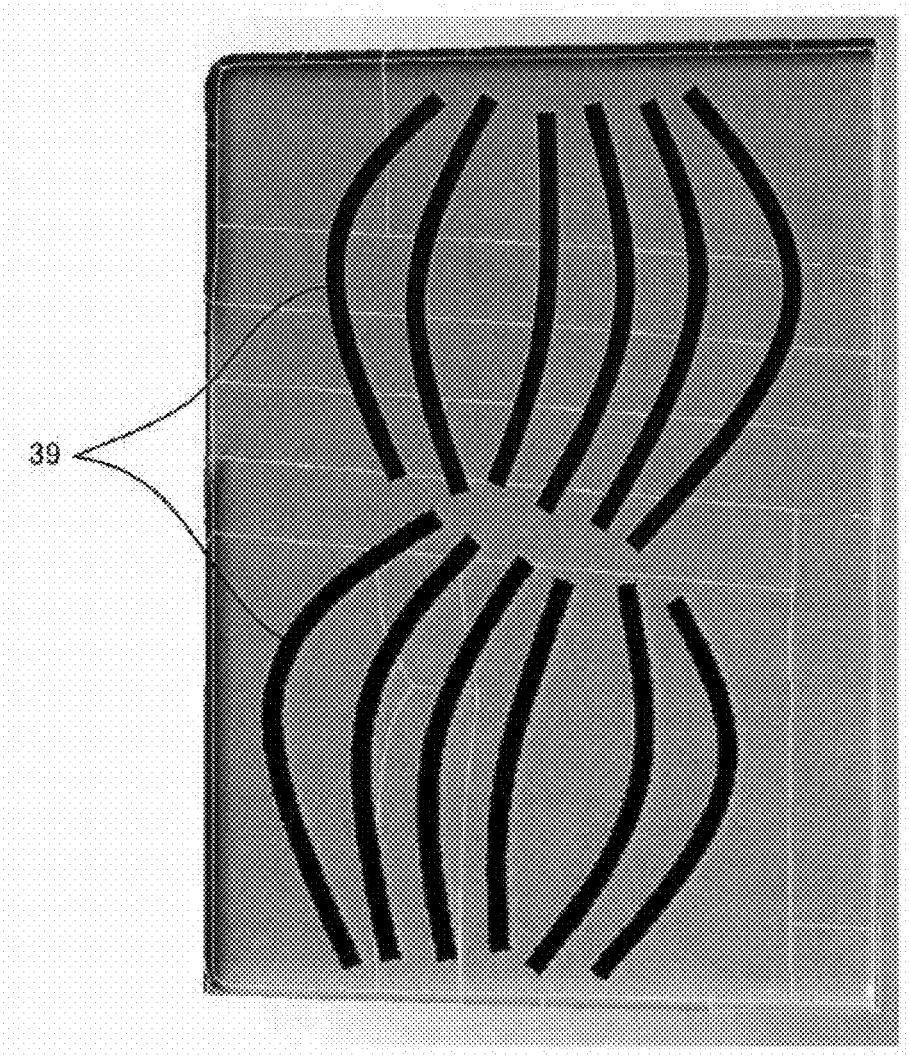
FIG. 12 is a diagram showing an example configuration of a rib fixed to an inner wall face of a speaker housing that is another embodiment of this invention.

In the above embodiment, the direction in which the ribs extend is determined based on the main stress generated when vibrations in the primary mode are generated. However, for example, the direction in which the ribs extend may alternatively be determined based on the main stress generated when vibrations in a higher mode, such as a secondary mode or a tertiary mode, are generated. For example, in an example shown in FIG. 12, the ribs are formed based on the main stress generated when vibrations in the secondary mode are generated. Accordingly, various ribs can be formed based on the direction of generated main stress, regardless of the mode of vibrations.

The shape of the speaker housing is not limited to a rectangular-parallelpiped as in the above embodiment, and various modes are possible. That is to say, an internal space need only be formed by the front wall to which the speaker unit is attached, as well as by a plurality of other walls, and the ribs need only be formed on at least some of the plurality of other walls.

REFERENCE SIGNS LIST

10 Speaker housing
11 Front wall
12 Back wall
13 Left wall
14 Right wall
15 Top wall
16 Bottom wall
31L to 35L, 31R to 35R, 31B to 35B Rib

The invention claimed is:

1. A speaker housing comprising:
a front wall where a speaker is to be attached;
at least one first wall;
at least one second wall; and
a plurality of ribs disposed on the first wall,
wherein the front wall, the first wall, and the second wall form an internal space,
a plurality of meshes that segment the first wall are defined, and
wherein the plurality of ribs are shaped according to contours of the direction of a maximum principal stress induced in the meshes by vibrations applied to the first wall in a state where the ribs are not disposed on the first wall.

2. The speaker housing according to claim 1, wherein each of the plurality of ribs has a continuous curved shape or straight shape formed by connecting the contours of the direction of the maximum principal stress induced in the adjacent meshes.

3. The speaker housing according to claim 1, wherein each of the plurality of ribs extends along the contours connecting the adjacent meshes where the orientations and magnitudes of the maximum principal stress induced in the adjacent meshes out of the plurality of adjacent meshes are closest.

4. The speaker housing according to claim 1, wherein heights of each of the plurality of ribs at positions corresponding to the meshes are determined in accordance with the von Mises stress induced to the first wall by the vibrations in the state where the plurality of ribs are not disposed on the first wall.

5. The speaker housing according to claim 1, wherein widths of each of the plurality of ribs at positions corresponding to the meshes are determined in accordance with the von Mises stress induced to the first wall by the vibrations in the state where the plurality of ribs are not disposed on the first wall.

6. The speaker housing according to claim 1, wherein the vibrations are in a primary mode.

7. A speaker housing comprising:

a front wall where a speaker is to be attached;

at least one first wall;

at least one second wall; and a plurality of ribs disposed on the first wall, wherein the front wall, the first wall, and the second wall form an internal space, wherein the plurality of ribs are disposed spaced along a first direction, and wherein at least some of the plurality of ribs are curved protruding along the first direction toward one of two opposing sides of the first direction, wherein the plurality of ribs include:

a first rib extending straight along a second direction that is perpendicular to the first direction;

at least one second rib that is disposed on one side of the first rib along the first direction and curved, protruding toward the one side; and at least one third rib that is disposed on the opposite side of the first rib along the first direction and curved, protruding toward the opposite side.

8. The speaker housing according to claim 7, wherein at least some of the plurality of ribs that are disposed away from a middle region in the first direction have a curvature radius thereof decreasing.

9. The speaker housing according to claim 7, wherein the plurality of ribs are configured so that the closer the ribs are disposed in a region nearer a middle of the first wall in the first direction, the greater at least one of a width or a height of the ribs is.

10. The speaker housing according to claim 7, wherein each of the plurality of ribs is configured so that at least one of a width or a height thereof varies along a direction in which the respective rib extends.

11. The speaker housing according to claim 7, wherein the plurality of ribs extend along a horizontal direction, which is perpendicular to the first direction.

* * * * *